United States Patent [19]

Niu et al.

[11] Patent Number: 4,637,822

[45] Date of Patent: Jan. 20, 1987

[54] COAL-OIL SLURRIES CONTAINING A SURFACTANT

[75] Inventors: Joseph H. Y. Niu, The Woodlands, Tex.; Irving R. Schmolka, Grosse Ile, Mich.

[73] Assignee: BASF Corporation, Wyandotte, Mich.

[21] Appl. No.: 317,051

[22] Filed: Nov. 2, 1981

[51] Int. Cl.[4] ..... C10L 1/32

[52] U.S. Cl. ..... 44/51; 44/72; 252/357

[58] Field of Search ..... 44/51, 72; 252/357

[56] References Cited

U.S. PATENT DOCUMENTS

| | | | |
|---|---|---|---|
| 3,036,130 | 5/1962 | Jackson et al. | 252/357 |
| 3,092,475 | 6/1963 | Cole et al. | 44/72 |
| 3,210,168 | 10/1965 | Morway | 44/51 |
| 4,276,054 | 6/1981 | Schmolka et al. | 44/51 |
| 4,288,232 | 9/1981 | Schmolka et al. | 44/51 |

FOREIGN PATENT DOCUMENTS

| | | | |
|---|---|---|---|
| 53-0072011 | 6/1978 | Japan | 44/51 |
| 55-0152785 | 11/1980 | Japan | 44/51 |

OTHER PUBLICATIONS

McCutcheon's *Detergents & Emulsifiers*, 1973, *North American Ed.*, Allured Publising Corp., Ridgewood, New Jersey, pp. 175 & 176, 1973.

Kirk-Othmer Encyclopedia of Chemical Technology, Standen, New York, vol. 19, pp. 560-561, 2nd ed.

*Primary Examiner*—William R. Dixon, Jr.
*Assistant Examiner*—Margaret B. Medley
*Attorney, Agent, or Firm*—Joseph D. Michaels

[57] ABSTRACT

Unwanted settling in a composition comprising a suspension of fine particles of coal in fuel oil is eliminated or substantially reduced by adding an effective amount of a polyoxypropylene-polyoxyethylene copolymer which corresponds to the formula:

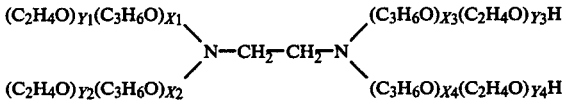

in which the values of $X_1$, $X_2$, $X_3$ and $X_4$ may be the same or different, $Y_1$, $Y_2$, $Y_3$ and $Y_4$ may be the same or different, $Y_1+Y_2+Y_3+Y_4$ give a total oxyethylene content of the molecule of from about 10 to 80 weight percent and $X_1$, $X_2$, $X_3$ and $X_4$ have values such that the total molecular weight of the molecule is from about 1500 to 30,000.

10 Claims, No Drawings

COAL-OIL SLURRIES CONTAINING A SURFACTANT

BACKGROUND OF THE INVENTION

1. Field of the Invention

The present invention relates in general to combustible fuel slurries containing liquid hydrocarbon fuel and particulate carbonaceous material, and more particularly, to the prevention or substantial reduction of the settling of the particulate carbonaceous material in the liquid hydrocarbon.

2. Description of the Prior Art

In recent years, the importance of reducing the dependency of the world upon natural gas and liquid hydrocarbon fuels for its energy has been dramatically demonstrated. While not constituting a complete solution to this problem, attempts have been made to add solid particulate carbonaceous material, such as coal, to liquid hydrocarbon fuels because such particulate carbonaceous materials are known to be far more plentiful than liquid fuels.

The idea of using in place of liquid hydrocarbon fuels, such as Bunker C fuel oil, a mixture of such oil and finely divided particles of carbonaceous material, such as bituminous or anthracite coal or lignite, is an old one. In a book published in 1926, *Fuels and Their Combustion* by Robert T. Haslam et al (McGraw-Hill, New York), there is a discussion on pages 135 and 136 of "colloidal fuel" which is referred to as an emulsion of solid fuel and oil developed by the Submarine Defense Association during World War I. This reference teaches mixing oil with a solid fuel, which may be any of the coals from lignite to anthracite, or peat, coke, or wood, provided that at least ⅔ of the dry solid fuel is combustible and that the fuel is pulverized so that 95 percent of it will pass through a 100 mesh screen and 85 percent of it will pass through a 200 mesh screen. This reference teaches the use of 30 weight percent of coal, 1.5 or 1.2 percent of "fixateur" and the remainder fuel oils, such as pressure-still oil or tar or coal tar. It teaches the use as "fixateur" of lime-rosin-grease (made by heating 83.5 percent oil, 10 percent rosin, 5 percent lime, and 1.5 percent water) or one of the coal tar distillates, such as creosol.

A considerably more extensive discussion of "colloidal fuel" appears at pages 226–234 of *Fuels and Combustion Handbook*, edited by Alan J. Johnson and George H. Auth, published by McGraw-Hill Book Co., New York, in 1951. This reference points out that the term "colloidal fuels" is a misnomer because in common usage, "colloidal solutions" are ones in which the particles are between 0.1 micron and 0.001 micron in mean diameter, whereas in these fuels, there are particles of coal which have been ground so that 100 percent of them will pass through a 100 mesh screen (150 microns) and 90 percent of them will pass through a 200 mesh screen (74 microns).

The Johnson et al reference shows that those skilled in the art have been aware of the advantages of coal-in-oil fuels: their use makes it possible to preserve petroleum resources, obtain better use of storage space, permit disposal of fines and low rank coals, etc.

This reference also points out that the behavior of a particular coal-in-oil fuel in respect to settling depends on a number of factors. If the fuel can be prepared constantly at the site of use so that there is a minimum of storage time, stabilization behavior of the coal-in-oil fuel is not important. If stirring or pumping to provide circulation can be used, again there is not much of a problem. Some mixtures remain stable for months without any additional treatment, particularly when the coal particles are fine, the concentration of the coal is relatively high, and the oil is relatively viscous and/or possesses a high specific gravity. Although it is desirable to use a relatively viscous oil, since this promotes the stability, the coal-in-oil mixture must not be permitted to become too viscous, because this gives difficulty in connection with pumping the fuel.

The Johnson et al reference also discusses the matter of stabilizers saying:

> ". . . it is a consensus that, with careful attention to a selection of fuels, pulverization, mixing, and storage, stabilizers can and should be avoided in most cases."

The reference cites the work of Aimison Jonnard, "Colloidal Fuel Development for Industrial Use", Bulletin 48, Kansas State College, Manhattan, Kansas, January 1946, reporting Jonnard's testing of 148 stabilizing agents. Jonnard "concluded that spent alkylation acid was the only one (of the stabilizers tested) with commercial possibilities."

For reasons set forth above, there is considerable renewed interest in the possibility of extending and/or supplementing liquid fuels with solid fuels. Numerous approaches have been taken to the problem of combining a solid particulate carbonaceous material with a liquid hydrocarbon fuel. It has become apparent to those skilled in the art that, if an effective stabilizing agent is found, the usefulness of the concept of using coal-in-oil fuel is greatly improved.

U.S. Pat. Nos. 3,907,134, issued Sept. 23, 1975 and 4,082,516, issued Apr. 4, 1978, to Grant W. Metzger, disclose the combination of solid particulate carbonaceous material such as powdered coal, a liquid hydrocarbon fuel such as Bunker C (No. 6) fuel oil, a stabilizing agent, preferably starch, and a viscosity reducing agent, preferably a detergent, more preferably soap, in the '134 patent and anionic surfactants in the '516 patent.

U.S. Pat. No. 4,090,853, issued May 23, 1978, to Clayfield et al, discloses a coal in liquid hydrocarbon fuel product which includes water as a stabilizer and may be further stabilized by the addition of small amounts of surfactants such as anionic surfactants.

U.S Pat. No. 4,276,054, issued June 30, 1981 to Schmolka et al discloses a coal in liquid hydrocarbon fuel which includes as a stabilizer a copolymer which corresponds to the formula:

$$Y[(C_2H_4O)_m(C_3H_6O)_nH]_x$$

wherein Y is the residue of an organic compound having from about 1 to 6 carbon atoms and containing x reactive hydrogen atoms in which x has a value of at least one, m has a value such that the oxyethylene content of the molecule is from about 10 to 40 weight percent and n has a value such that the total molecular weight of the polyoxyalkylene groups is from about 2000 to 6000.

U.S. Pat. No. 4,251,229, issued Feb. 17, 1981, discloses a fuel slurry composition comprising a fuel oil pulverized coal, and an effective amount of a stabilizing agent selected from a group which includes a polyether-type adduct having a molecular weight from 1,000 to 100,000 between a lower alkylene oxide and a compound having at least three active hydrogen atoms selected from the group consisting of an alcohol, an amine, a carboxylic acid and a phenol.

U.S. Pat. No. 4,252,540, issued Feb. 24, 1981, Massaki et al, discloses a stabilizer for mixed fuels of finely divided coal and fuel oil. This stabilizer is a non-ionic surface active agent consisting of a block copolymer represented by the following general formula:

$$R^1O\text{-}(C_2H_4O)_l\text{-}(C_3H_6O)_m\text{-}(C_2H_4O)_n\text{-}R^2.$$

U.S. Pat. No. 4,130,401, issued Dec. 19, 1978, discloses combustible fuel slurries prepared by admixing solid particulate carbonaceous material, liquid hydrocarbon fuel, and a wetting agent having an HLB value in the range of 6.5 to 10.

SUMMARY OF THE INVENTION

Good results in terms of preventing or substantially reducing unwanted settling in compositions comprising a suspension of solid particulate carbonaceous material in a liquid hydrocarbon fuel are obtained by including in the mixture a small but effective amount of a polyoxyethylene-polyoxypropylene copolymer stabilizing agent which corresponds to the formula:

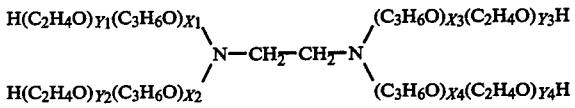

in which the values of $X_1$, $X_2$, $X_3$ and $X_4$ may be the same or different, $Y_1$, $Y_2$, $Y_3$ and $Y_4$ may be the same or different, $Y_1+Y_2+Y_3+Y_4$ give a total oxyethylene content of the molecule of from about 10 to 80 weight percent and $X_1$, $X_2$, $X_3$ and $X_4$ have values such that the total molecular weight of the molecule is from about 1500 to 30,000. This produces a high solids content stable and combustible fuel slurry comprising solid particulate carbonaceous material, liquid hydrocarbon fuel, and the above-described stabilizing agent. In addition, small amounts of water and/or aromatic hydrocarbon solvent have been found to improve antisettling properties in some cases.

DESCRIPTION OF THE PREFERRED EMBODIMENTS

The combustible fuel slurry of the present invention is principally comprised of a solid particulate carbonaceous material and a liquid hydrocarbon fuel. As used herein, "solid particulate carbonaceous material" shall include such materials as bituminous and anthracite coals, coke, petroleum coke, lignite, charcoal, peat, etc., and combinations thereof. The expression "liquid hydrocarbon fuel" as used herein shall include crude and refined hydrocarbon based oils, including without limitation by enumeration, petroleum fuel oils, heavy residual oils and crude oils, and the like. More particularly, liquid hydrocarbon fuel oils having a viscosity in the range of about 50 to about 300 seconds Saybolt Universal at 175° F. are preferred. Bunker C (No. 6) residual fuel oil is particularly useful in the slurry of the present invention.

It is preferred that the particulate carbonaceous material be powdered or pulverized to a size which will enable substantially the entire quantity employed in the slurry to pass through a 100 mesh sieve or screen and at least 80 percent to pass through a 200 mesh screen. While such screening results in relatively small particle sizes, the particles are considerably larger than colloidal size, and some particles larger than a 200 mesh screen but less than 100 mesh can be tolerated. The cost of pulverizing or grinding coal or the like to a size appreciably below 200 mesh, particularly colloidal size, begins to increase dramatically, which could eliminate the economic advantages of the present slurry. It has been found that such additional grinding does not produce any material advantage in the practice of the present invention. For simplicity's sake, the solid particulate carbonaceous material shall be referred to herein as coal although it is to be understood that it includes bituminous and anthracite coals, coke, petroleum coke, lignite, charcoal, peat, etc., and combinations thereof. Similarly, the liquid hydrocarbon fuel will be referred to herein as oil although it is to be understood that it includes petroleum fuel oils, heavy residual oils, crude oils and the like.

In general, the proportion of coal to oil by weight will range from about 20:80 to 55:45. In accordance with the prior art, there are indications that it is generally difficult to obtain a satisfactory composition whenever the percentage of coal exceeds 43 percent by weight because the mixture tends to become viscous and too difficult to pump. However, it was found that, with the use of a stabilizer in accordance with the present invention, it is possible to obtain a composition which performs satisfactorily even at equal weights of coal and oil and even up to 55 percent by weight coal. A preferred range is 40:60 to 50:50 coal to oil by weight, neglecting for the present any other ingredients present in minor quantities.

In accordance with the present invention, there is used as a stabilizer at least one polyoxyethylene-polyoxypropylene copolymer which corresponds to the formula:

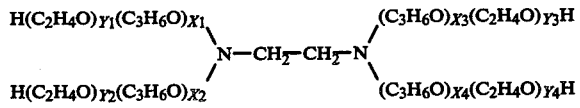

in which the values of $X_1$, $X_2$, $X_3$ and $X_4$ may be the same or different, $Y_1$, $Y_2$, $Y_3$ and $Y_4$ may be the same or different, $Y_1+Y_2+Y_3+Y_4$ give a total oxyethylene content of the molecule of from about 10 to 80 weight percent and $X_1$, $X_2$, $X_3$ and $X_4$ have values such that the total molecular weight of the molecule is from about 1500 to 30,000. Compositions of this type are more particularly described in U.S. Pat. No. 2,979,528. In the above formula, the oxypropylene chains optionally, but advantageously, contain small amounts of ethylene oxide and the oxyethylene chains also optionally, but advantageously, contain small amounts of alkylene oxides such as propylene oxide and butylene oxide.

The proportion of stabilizer used may range from about 0.05 to 5 percent by weight, preferably 0.1 to 1 percent by weight, of the total of coal, oil, stabilizer and any other components in the overall composition. In any event, a proportion sufficient to give a substantial stabilizing effect is required and, in most cases, the addition of a proportion greater than about 1.5 percent merely adds to the cost without conferring any corresponding benefit.

Water may be optionally present in the composition. Ordinarily, at least a small proportion of water will be present, because it is common to have water present during the operation of grinding coal as a measure to control the development of dust, and it is difficult, costly and time-consuming to remove all the water after the grinding operation, before the coal is mixed with the oil. Thus, water may be present in an amount up to about 10 percent, preferably up to about 6 percent, by weight taking the total of the coal, water, stabilizer and oil as 100 percent.

Also, it has been found that the addition of a conventional aromatic hydrocarbon solvent can be useful. Suitable solvents for this purpose are: toluene, xylene, benzene, chlorobenzene, other substituted aromatic organic solvents, preferably higher boiling aromatic solvents and mixtures thereof. The solvent may be employed in an amount from about 0 to 5 and preferably 0.05 to 1.0 percent by weight, taking the total of coal, solvent, and oil as 100 percent.

The stabilizer may be mixed with the other ingredients in any suitable manner. Usually, it is desirable to have the fuel oil at a temperature such that the viscosity is relatively low, so that the mixture may be readily stirred. A preferred temperature range is about 120°-150° F. In principle, however, the manner of mixing the stabilizer with the other ingredients is not important, so long as a homogeneous mixture is obtained.

Following are specific, non-limiting examples which are provided to illustrate the instant invention. All parts, percentages and proportions are by weight unless otherwise indicated.

EXAMPLE 1

Two 150 gram coke/oil/water mixtures containing by weight 30 percent coke, 67.5 percent oil and 2.5 percent water were prepared by mixing in a Tekmar "Super Dispax System". The petroleum coke was pulverized to 100 percent passing through a 200 mesh screen. No. 6 (Bunker C) fuel oil was employed as the liquid hydrocarbon fuel. A stabilizer sold under the trademark TETRONIC ®1307 was then added to one of the mixtures in amount of 0.20 percent by weight of the total mixture. No stabilizer was added to the other mixture.

The stabilizer was a nonionic surfactant having the following generalized formula:

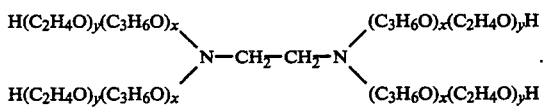

The polyoxypropylene groups (x) have a total molecular weight of 5600 and the oxyethylene content (y) is about 70 weight percent of the molecule.

Two aspects of stabilization were investigated, i.e., the settling and redispersing characteristics. The settling was measured by means of a K scan instrument which determined the dielectric constant (pf) of a small section of coke/oil mixture in a 30 millimeter diameter tube which was filled with the mixture to a height of approximately 150 millimeters.

The redispersibility was examined by poking the mixture with a glass rod (10 millimeter diameter). With an easily dispersed mixture, the glass rod will reach the bottom of the tube with little effort.

After 16 days, the coke/oil mixture containing the stabilizer reached an equilibrium and the settled coal was found to redisperse easily. In the coke/oil mixture with no stabilizer, the coke settled in a few days and could not be redispersed as evidenced by the fact that the glass rod could only reach half way down the tube.

EXAMPLE 2

A 150 gram coke/oil mixture is prepared as described in Example 1 with the exception that TETRONIC ®702 polyol is substituted for the TETRONIC 1307 polyol stabilizer. This stabilizer has the same general formula as the stabilizer of Example 1 except that the polyoxypropylene groups (x) have a total molecular weight of 2600 and the oxyethylene content (y) is about 20 weight percent. A stabilized slurry having good settling and redispersing properties is obtained.

EXAMPLE 3

A 150 gram coal/oil mixture is prepared as described in Example 1 wherein an average eastern bituminous coal is substituted for the petroleum coke. A stabilized slurry having good settling and redispersing properties is obtained.

EXAMPLE 4

A 150 gram coke/oil mixture is prepared as described in Example 1 with the exception that TETRONIC ®1508 polyol is substituted for the TETRONIC 1307 polyol stabilizer. izer. This stabilizer has the same general formula as the stabilizer of Example 1 except that the polyoxypropylene groups (x) have a total molecular weight of 6500 and the oxyethylene content (y) is about 80 weight percent. A stabilized slurry having good settling and redispersing properties is obtained.

The embodiments of the invention in which an exclusive property or privilege is claimed are defined as follows:

1. A combustible slurry comprising solid particulate carbonaceous material having particles sufficiently fine so that at least 80 percent pass through a 200 mesh screen, liquid hydrocarbon fuel in the amount of about 45 to 80 percent by weight, about 0.05 to 5 percent by weight of a polyoxyethylene-polyoxypropylene copolymer, and up to about 10 percent by weight of water; said copolymer having the formula:

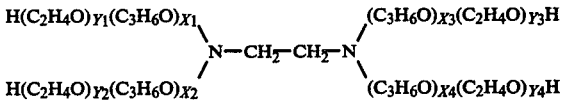

in which the values of $X_1$, $X_2$, $X_3$ and $X_4$ may be the same or different, $Y_1$, $Y_2$, $Y_3$ and $Y_4$ may be the same or different, $Y_1+Y_2+Y_3+Y_4$ give a total oxyethylene content of the molecule of from about 10 to 80 weight percent and $X_1$, $X_2$, $X_3$ and $X_4$ have values such that the total molecular weight of the molecule is from about 1500 to 30,000.

2. The slurry of claim 1 wherein said carbonaceous material is petroleum coke.

3. The slurry of claim 2 wherein said petroleum coke is in the form of particles sufficiently fine that 100 percent pass through a 200 mesh screen.

4. The slurry of claim 1 wherein said carbonaceous material is bituminous coal.

5. The fuel slurry of claim 1 wherein the content of said copolymer ranges from about 0.1 to 1 percent by weight of the total composition.

6. The fuel slurry of claim 5 wherein the ratio of said solid particulate carbonaceous material to said liquid hydrocarbon fuel ranges from by weight about 20:80 to 55:45.

7. The fuel slurry of claim 5 wherein said slurry contains up to about 6 percent by weight of water.

8. The fuel slurry of claim 5 wherein said slurry contains water in amount from about 0.05 to 10 percent by weight.

9. The fuel slurry of claim 6 wherein said slurry contains up to about 6 percent by weight of water.

10. The fuel slurry of claim 6 wherein said slurry contains water in amount from about 0.05 to 10 percent by weight.

* * * * *